US010435826B2

(12) United States Patent
Strandqvist et al.

(10) Patent No.: US 10,435,826 B2
(45) Date of Patent: Oct. 8, 2019

(54) PROCESS FOR PRODUCING NONWOVEN WITH IMPROVED SURFACE PROPERTIES

(71) Applicant: SCA Hygiene Products AB, Göteborg (SE)

(72) Inventors: Mikael Strandqvist, Gotëborg (SE); Hannu Ahoniemi, Göteborg (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 15/780,416

(22) PCT Filed: Dec. 1, 2015

(86) PCT No.: PCT/EP2015/078152
§ 371 (c)(1),
(2) Date: May 31, 2018

(87) PCT Pub. No.: WO2017/092791
PCT Pub. Date: Jun. 8, 2017

(65) Prior Publication Data
US 2018/0355527 A1 Dec. 13, 2018

(51) Int. Cl.
*D04H 1/4374* (2012.01)
*D04H 1/4266* (2012.01)
(Continued)

(52) U.S. Cl.
CPC ..... *D04H 1/4374* (2013.01); *D04H 1/4266* (2013.01); *D04H 1/465* (2013.01);
(Continued)

(58) Field of Classification Search
CPC .... D04H 1/4374; D04H 1/4266; D04H 1/465; D04H 1/492; D04H 1/498; D04H 3/105;
(Continued)

(56) References Cited

U.S. PATENT DOCUMENTS 2,286,942 A * 6/1942 Tuten ..... D21F 11/04 162/123
4,425,187 A * 1/1984 Armstrong ..... D21F 9/006 162/299
(Continued)

FOREIGN PATENT DOCUMENTS

CA 841938 A 5/1970
CA 3006600 A1 * 6/2017 ..... D04H 1/4266
(Continued)

OTHER PUBLICATIONS

First Examination Report issued in New Zealand patent application No. 743252, dated Sep. 17, 2018.
(Continued)

*Primary Examiner* — Jose A Fortuna
(74) *Attorney, Agent, or Firm* — Drinker Biddle & Reath LLP

(57) ABSTRACT

A hydroentangled nonwoven sheet material produced by a process including: 0) optionally providing a polymer web on a carrier; a) providing an aqueous suspension containing short fibers and a surfactant; b) depositing the aqueous suspension on the carrier; c) removing aqueous residue of the aqueous suspension deposited in step b) to form a fibrous web; b') depositing aqueous suspension on a surface of the fibrous web formed in step c); c') removing aqueous residue of the aqueous suspension deposited in step b') to form a combined fibrous web; d) hydroentangling the combined fibrous web; and optionally e) drying the hydroentangled web, and/or f) further processing and finalizing the dried, hydroentangled web the web to produce the nonwoven end material. The hydroentangled non-woven sheet material obtainable by this process has a low degree of surface irregularity and contains low residues of surfactants.

10 Claims, 1 Drawing Sheet

(51) Int. Cl.

| | |
|---|---|
| ***D04H 1/492*** | (2012.01) |
| ***D04H 1/498*** | (2012.01) |
| ***D04H 5/03*** | (2012.01) |
| ***D21H 27/00*** | (2006.01) |
| ***D21H 27/34*** | (2006.01) |
| ***D21H 27/36*** | (2006.01) |
| ***D21F 11/00*** | (2006.01) |
| ***D04H 1/46*** | (2012.01) |
| ***D04H 3/105*** | (2012.01) |
| ***D21H 27/42*** | (2006.01) |
| ***D21H 21/24*** | (2006.01) |
| ***D21H 21/56*** | (2006.01) |

(52) U.S. Cl.
CPC ..... *D04H 1/492* (2013.01); *D04H 1/498* (2013.01); *D04H 3/105* (2013.01); *D04H 5/03* (2013.01); *D21F 11/002* (2013.01); *D21H 5/2685* (2013.01); *D21H 21/24* (2013.01); *D21H 21/56* (2013.01); *D21H 27/002* (2013.01); *D21H 27/34* (2013.01); *D21H 27/36* (2013.01)

(58) Field of Classification Search
CPC ..... D04H 5/03; D21F 11/002; D21H 21/24; D21H 21/56; D21H 27/002; D21H 27/34; D21H 27/36
See application file for complete search history.

(56) References Cited

U.S. PATENT DOCUMENTS

| | | | | |
|---|---|---|---|---|
| 4,443,297 | A * | 4/1984 | Cheshire | D21F 11/002 162/101 |
| 4,498,956 | A * | 2/1985 | Cheshire | D21F 11/002 162/101 |
| 5,106,457 | A * | 4/1992 | Manning | D21H 13/14 162/115 |
| 5,853,538 | A * | 12/1998 | Reiner | D21F 11/002 162/101 |
| 6,624,100 | B1 * | 9/2003 | Pike | D01D 5/0985 428/397 |
| 2001/0013389 | A1 | 8/2001 | Fingal et al. | |
| 2001/0029966 | A1 * | 10/2001 | Wong | A47L 13/16 134/6 |
| 2002/0088099 | A1 * | 7/2002 | Ahoniemi | D04H 3/02 28/103 |
| 2003/0000665 | A1 * | 1/2003 | Takai | D21H 25/005 162/115 |
| 2003/0213108 | A1 * | 11/2003 | Strandqvist | D21F 1/0063 28/104 |
| 2003/0232553 | A1 * | 12/2003 | Strandqvist | D21F 9/00 442/59 |
| 2005/0091811 | A1 * | 5/2005 | Billgren | D04H 5/02 28/104 |
| 2005/0092417 | A1 * | 5/2005 | Billgren | D04H 1/425 156/62.2 |
| 2005/0112980 | A1 * | 5/2005 | Strandqvist | D04H 5/03 442/416 |
| 2005/0136776 | A1 | 6/2005 | Clark et al. | |
| 2007/0010156 | A1 * | 1/2007 | Strandqvist | D04H 3/11 442/408 |
| 2010/0272938 | A1 * | 10/2010 | Mitchell | D21H 13/40 428/36.1 |
| 2013/0213594 | A1 * | 8/2013 | Jaakkola | D21F 1/08 162/123 |
| 2014/0090217 | A1 * | 4/2014 | Jonsson | D04H 1/4374 28/103 |
| 2015/0083354 | A1 * | 3/2015 | Strandqvist | D04H 1/498 162/146 |
| 2015/0330004 | A1 * | 11/2015 | Str Lin | B31F 1/07 428/156 |
| 2016/0040337 | A1 * | 2/2016 | Dutkiewicz | D04H 1/559 428/172 |
| 2018/0355527 | A1 * | 12/2018 | Strandqvist | D04H 1/4266 |
| 2018/0363177 | A1 * | 12/2018 | Strandqvist | D04H 1/46 |
| 2018/0363182 | A1 * | 12/2018 | Bergmann | D04H 1/495 |

FOREIGN PATENT DOCUMENTS

| | | | | |
|---|---|---|---|---|
| JP | 2002285466 | A * | 10/2002 | D04H 1/498 |
| RU | 2211272 | C2 | 8/2003 | |
| RU | 2266768 | C2 | 9/2009 | |
| WO | WO-96/02701 | A1 | 2/1996 | |
| WO | WO-99/22059 | A1 | 5/1999 | |
| WO | WO-03/040469 | A1 | 5/2003 | |
| WO | WO-2005/042819 | A2 | 5/2005 | |
| WO | WO-2012/150902 | A1 | 11/2012 | |
| WO | WO-2012150902 | A1 * | 11/2012 | D04H 1/4374 |
| WO | WO-2013/015735 | A1 | 1/2013 | |
| WO | WO-2013/095241 | A1 | 6/2013 | |
| WO | WO-2014104955 | A1 * | 7/2014 | D04H 5/03 |
| WO | WO-2014104956 | A1 * | 7/2014 | B31F 1/07 |
| WO | WO-2017092791 | A1 * | 6/2017 | D04H 1/4266 |

OTHER PUBLICATIONS

Further Examination Report issued in New Zealand patent application No. 743252, dated Mar. 13, 2019.
Colombian Office Action No. 1720 dated Apr. 29, 2019 issued in Colombian application No. NC2018/0005716 (8 pages) and its English-language translation thereof (5 pages).
Russian Office Action dated Apr. 12, 2019 issued in Russian patent application No. 2018123477 (7 pages) and its English-language translation thereof (8 pages).

* cited by examiner

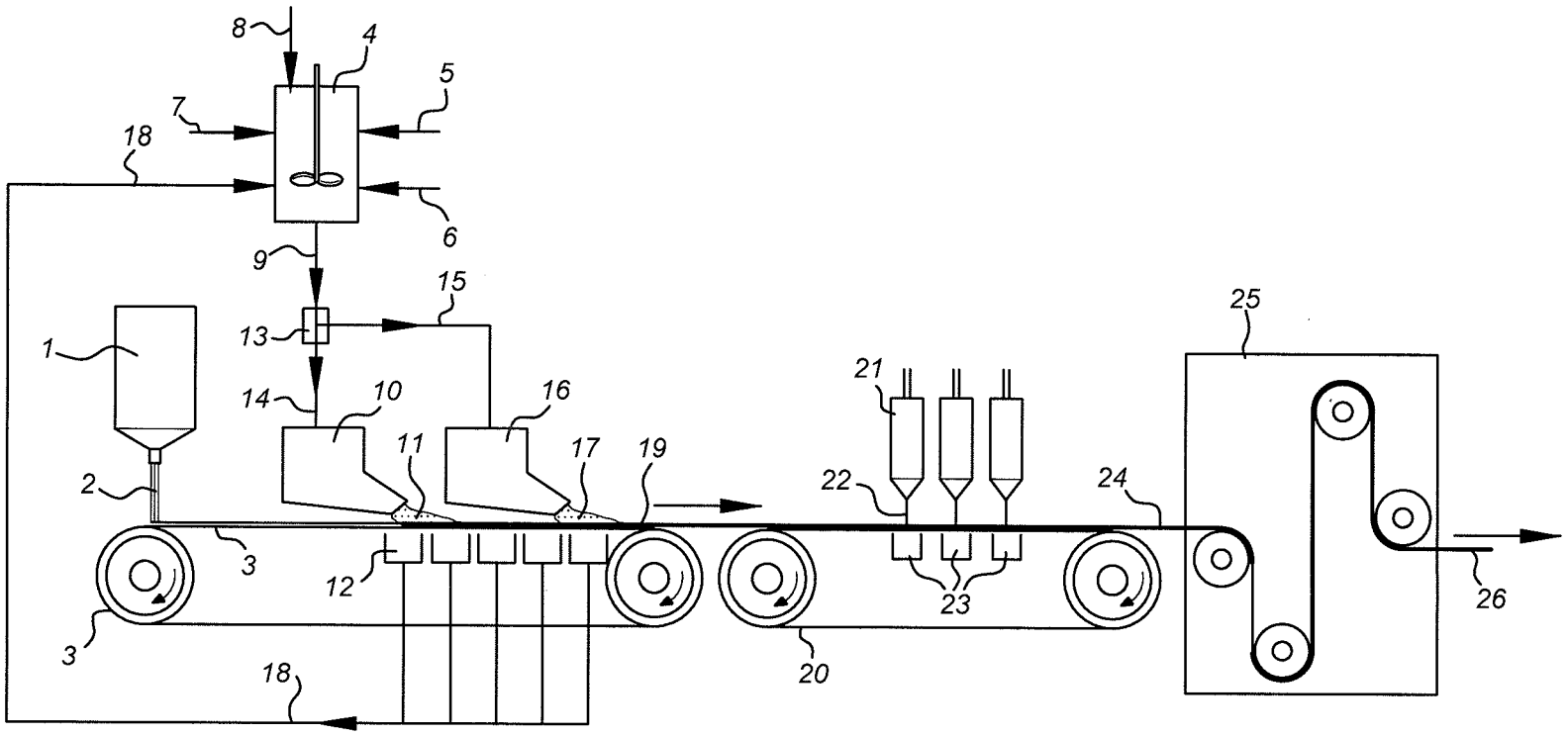
1
2
3
3
4
5
6
7
8
9
10
11
12
13
14
15
16
17
18
18
19
20
21
22
23
24
25
26

PROCESS FOR PRODUCING NONWOVEN WITH IMPROVED SURFACE PROPERTIES

CROSS-REFERENCE TO PRIOR APPLICATION

This application is a § 371 National Stage Application of PCT International Application No. PCT/EP2015/078152 filed Dec. 1, 2015, which is incorporated herein in its entirety.

TECHNICAL FIELD

The present disclosure relates to a process for producing a fibre-containing nonwoven sheet material having a minimum of surface irregularities and to a sheet material which is obtainable by such a process.

BACKGROUND

Absorbent nonwoven materials are used for wiping various types of spills and dirt in industrial, medical, office and household applications. They typically include a combination of thermoplastic polymers (synthetic fibres) and cellulosic pulp for absorbing both water and other hydrophilic substances, and hydrophobic substances (oils, fats). The nonwoven wipes of this type, in addition to having sufficient absorptive power, are at the same time strong, flexible and soft. They can be produced by wet-laying a pulp-containing mixture on a polymer web, followed by dewatering and hydroentangling to anchor the pulp onto the polymer and final drying. Absorbent nonwoven materials of this type and their production processes are disclosed in WO 2005/042819.

WO 99/22059 discloses a method of producing a nonwoven sheet material by providing melt-blown or spun-laid synthetic continuous filaments to form a polymer layer, applying a foam of natural (pulp) fibres on a side thereof through a head box to produce a combination of synthetic filaments and natural fibres, followed by hydroentangling the combination using water jets, to produce a composite sheet material in which the filaments and the natural fibres are intimately integrated resulting in high strength and high stiffness sheet material. The hydroentanglement can be preceded by applying the foam also on the other side of the polymer layer. WO 03/040469 teaches a similar process in which part of the starting materials is directly introduced into the head box, i.e. separate from the foam.

WO 2012/150902 discloses a method of producing a hydroentangled nonwoven material wherein a first fibrous web of synthetic staple fibres and natural (pulp) fibres is wet-laid and hydroentangled, spun-laid filaments are laid on top of the hydroentangled first fibrous web and a second fibrous web of natural fibres is wet-laid on top of the filaments and subsequently hydroentangled. The web is then reversed and subjected to a third hydroentangling treatment at the side of the first fibrous web, to produce a strong composite sheet material having essentially identical front and back sides.

Desirable results in terms of flexibility, sheet strength and absorption capacity are obtained when the pulp-containing web is produced by applying the pulp in the form of a foam containing a surfactant, onto or together with a synthetic polymer, and bonding the combined pulp fibres and synthetic polymer by hydroentanglement. However, surface irregularities or even thin spots or holes in the final sheet material may result, which negatively affect the sheet properties and performances as well as its appearance. This problem could be reduced by using relatively high levels of surfactant in the foam-forming pulp mixture, but high levels of surfactant turn out to hamper the hydroentangling process. In particular, it has been shown that high levels of surfactant may hamper the water purification in the recycling loop of water used in the hydroentangling, which in turn may interfere with the hydroentangling of the nonwoven material and hence result in suboptimum bonding in the nonwoven product.

Thus, there is a need for a process of producing hydroentangled nonwoven materials which avoids the drawbacks of irregular or defective surface characteristics and excessive use of surfactants.

SUMMARY

It is desired to provide a hydroentangled, absorbent fibre-containing nonwoven material having reduced surface irregularities and limited levels of surfactants, in combination with high strength resulting from effective bonding through hydroentanglement.

It is also desired to provide a process for producing such nonwoven materials which involves multiple steps of wet-laying a fibre-containing suspension prior to hydroentanglement.

BRIEF DESCRIPTION OF THE DRAWINGS

The accompanying FIGURE diagrammatically depicts an installation for producing absorbent pulp-containing nonwoven sheet material of the present disclosure.

DETAILED DESCRIPTION OF PARTICULAR EMBODIMENTS

The present process of producing a hydroentangled nonwoven sheet material includes:

a) providing an aqueous suspension containing short fibres and a surfactant;
b) depositing the aqueous suspension on a carrier,
c) removing aqueous residue of the aqueous suspension deposited in step b) to form a fibrous web,
b') depositing aqueous suspension containing short fibres and a surfactant on a surface of the fibrous web formed in step c),
c') removing aqueous residue of the aqueous suspension deposited in step b') to form a combined fibrous web,
b", c") optionally repeating steps b') and c'), and subsequently
d) hydroentangling the combined fibrous web, and optionally
e) drying the hydroentangled web, and/or
f) further processing and finalising the dried, hydroentangled web the web to produce the nonwoven end material.

An important feature of the present disclosure is that the combination of steps b) and c) is repeated at least once, wherein any repeating deposition of aqueous suspension containing short fibres and a surfactant is applied on a surface of the fibrous web of short fibres that has been previously formed. The composition of the aqueous suspension to be used in steps b) and b') and optional further steps b") may be different or the same, but, in a particular embodiment, are is preferably essentially the same. In particular embodiments, the dry solids content of the fibrous web after step c) and before step b') is at least 15 wt. %, between 20 and 40 wt. %, or between 25 and 30 wt. %.

The amounts of aqueous suspension to be applied in steps b) and b') may be the same or different. For example, between 25 and 75 wt. % of the aqueous suspension (on dry solids basis) can be applied in step b), between 15 and 60 wt. % of the aqueous suspension can be applied in step b'), and between 0 and 40 wt. % of the aqueous suspension can be applied in one or more optional further steps b") following step c').

The short fibres may include natural fibres and/or synthetic fibres and may in particular have average lengths between 1 and 25 mm. Part or all of the natural short fibres may include cellulosic pulp having fibre lengths of between 1 and 5 mm. The cellulosic (pulp) fibres may constitute at least 25 wt. %, 40-95 wt. %, or 50-90 wt. %, of the short fibres to be provided in step a). Instead or in addition, the short fibres may include man-made staple fibres having fibre lengths of between 5 and 25 mm, or between 6 and 18 mm. The staple fibres may constitute at least 3 wt. %, or 5-50 wt. % of the short fibres to be provided in step a).

In particular embodiments, the aqueous suspension contains the short fibres at a level of between 1 and 25 wt. %. In particular embodiments, the suspension contains between 0.01 and 0.1 wt. % of a non-ionic surfactant. Advantageously, the aqueous suspension is applied as a foam containing between 10 and 90 vol. % of air.

In the present disclosure, the indication "between x and y" and "from x to y", wherein x and y are numerals, are considered to be synonymous, the inclusion or exclusion of the precise end points x and y being of theoretical rather than practical meaning.

In a particular embodiment, the present process includes providing a polymer web on the carrier prior to step b), onto which the aqueous suspension can be deposited in multiple steps. The polymer web may be formed by a spun-laid, air-laid or carding process step. In particular embodiments, the polymer web contains at least 50 wt. % of synthetic filaments. In another embodiment, the present process includes an optional step of depositing a polymer layer on the deposited (combined) fibrous web after steps b) and c), and, in a particular embodiment, after step c').

In a particular embodiment, the aqueous suspension is deposited at the same side in steps b) and b'), while optional further depositions in steps b") may be at the same or opposite sides. In additional embodiments, hydroentanglement of step d) is performed only from one side. As a result, the nonwoven material as produced may have front and back surfaces of different composition.

Further details of the various steps and materials to be applied are described below.

a. Carrier and Polymer Web

A carrier on which the aqueous composition can be applied, can be a forming fabric, which can be a running belt-like wire having at least the breadth of the sheet material to be produced, which fabric allows draining of liquid through the fabric. In an embodiment, a polymer web can first be deposited on the carrier by laying man-made fibres on the carrier. The fibres can be short or long distinct (staple) fibres and/or continuous filaments. In particular embodiments, filaments are used. In another embodiment, a polymer layer can be deposited on the fibrous web obtained in steps b) and c), in particular embodiments, after step c') or even after step c"), but before step d). It is also possible to first deposit a polymer layer, followed by depositing the aqueous suspension to form a fibrous web on the polymer web and to deposit a further polymer layer on the fibrous web.

Filaments are fibres that in proportion to their diameter are very long, in principle endless, during their production. They can be produced by melting and extruding a thermoplastic polymer through fine nozzles, followed by cooling, for example using an air flow, and solidification into strands that can be treated by drawing, stretching or crimping. The filaments may be of a thermoplastic material having sufficient coherent properties to allow melting, drawing and stretching. Examples of useful synthetic polymers are polyolefins, such as polyethylene and polypropylene, polyamides such as nylon-6, polyesters such as poly(ethylene terephthalate) and polylactides. Copolymers of these polymers may of course also be used, as well as natural polymers with thermoplastic properties. Polypropylene is a particularly suitable thermoplastic man-made fibre. Fibre diameters can e.g. be in the order of 1-25 μm. Staple fibres can be of the same man-made materials as filaments, e.g. polyethylene, polypropylene, polyamides, polyesters, polylactides, cellulosic fibres, and can have lengths of e.g. 2-40 mm. In particular embodiments, the polymer web contains at least 50 wt. % of thermoplastic (synthetic) filaments, or at least 75 wt. % of synthetic filaments. The combined web contains between 15 and 45 wt. % of the synthetic filaments on dry solids basis of the combined web.

b. Aqueous Fibre Suspension

The aqueous suspension is obtained by mixing short fibres and water in a mixing tank. The short fibres can include natural fibres, in particular cellulosic fibres. Among the suitable cellulosic fibres are seed or hair fibres, e g cotton, flax, and pulp. Wood pulp fibres are especially well suited, and both softwood fibres and hardwood fibres are suitable, and also recycled fibres can be used. The pulp fibre lengths can vary between 0.5 and 5, in particular from 1 to 4 mm, from around 3 mm for softwood fibres to around 1.2 mm for hardwood fibres and a mix of these lengths, and even shorter, for recycled fibres. The pulp can be introduced as such, i.e. as pre-produced pulp, e.g. supplied in sheet form, or produced in situ, in which case the mixing tank is commonly referred to as a pulper, which involves using high shear and possibly pulping chemicals, such as acid or alkali.

In addition or instead of the natural fibres, other materials can be added to the suspension, such as in particular other short fibres. Staple (man-made) fibres of variable length, e.g. 5-25 mm, can suitably be used as additional fibres. The stable fibres can be man-made fibres as described above, e.g. polyolefins, polyesters, polyamides, poly(lactic acid), or cellulose derivatives such as lyocell. The staple fibres can be colourless, or coloured as desired, and can modify further properties of the pulp-containing suspension and of the final sheet product. Levels of additional (man-made) fibres, in particular staple fibres, can suitably be between 3 and 50 wt. %, between 5 and 30 wt. %, between 7 and 25 wt. %, or between 8 and 20 wt. % on the basis of the dry solids of the aqueous suspension.

When using polymer fibres as additional material, it is usually necessary to add a surfactant to the pulp-containing suspension. Suitable surfactants include anionic, cationic, non-ionic and amphoteric surfactants. Suitable examples of anionic surfactants include long-chain (lc) (i.e. having an alkyl chain of at least 8 carbon atoms, in particular at least 12 carbon atoms) fatty acid salts, lc alkyl sulfates, lc alkylbenzenesulfonates, which are optionally ethoxylated. Examples of cationic surfactants include lc alkyl ammonium salts. Suitable examples of non-ionic surfactants include ethoxylated lc fatty alcohols, ethoxylated is alkyl amides, lc alkyl glycosides, is fatty acid amides, mono- and diglycerides etc. Examples of amphoteric (zwitterionic) surfactants include lc alkylammonio-alkanesulfonates and choline-based or phosphatidylamine-based surfactants. The level of surfactant (on the basis of the aqueous suspension) can be between 0.005 and 0.2, between 0.01 and 0.1, or between 0.02 and 0.08 wt. %.

It can further be advantageous for an effective application of the aqueous suspension to add air to the suspension, i.e. to use it as a foam. The amount of air introduced into the suspension (e.g. by stirring the suspension) can be between 5 and 95 vol. % of the final suspension (including the air), between 15 and 80 vol. %, between 20 and 60 vol. % or between 20 and 40 vol. %. The more air is present in the foam, often the higher levels of surfactants are required. As used herein, the term "air" is to be interpreted broadly as any non-noxious gas, typically containing at least 50% of molecular nitrogen, and further varying levels of molecular oxygen, carbon dioxide, noble gases etc. Further information about foam formation as such can be found e.g. in WO 03/040469.

b1. First Application of the Fibre Suspension

The aqueous suspension containing short fibres is deposited on the carrier, either directly or on a polymer web, e.g. using a head box, which guides and spreads the suspension evenly over the width of the carrier or the web in the direction of the running fabric, causing the suspension to partly penetrate into the polymer web. The speed of application of the aqueous suspension, which is the running speed of the fabric (wire) and thus typically the same as the speed of laying the polymer web, can be high, e.g. between 1 and 8 m/sec (60-480 m/min), especially between 3 and 5 m/sec. The total amount of liquid circulated by the wet-laying or foam laying can be in the order of 50-125 l/sec (3-7.5 $m^3$/min), especially 75-110 l/sec (4.5-6.6 $m^3$/min).

c. Removal of Aqueous Residue After the Application of the Suspension

Surplus liquid and gas phase are sucked through the web and the fabric in step c), leaving the short fibres and other solids in and on the web. The spent liquid and gas can be separated, processed and the liquid returned to the mixing tank for producing fresh aqueous fibre suspension.

b2. Second and Further Application of the Fibre Suspension

An important feature of the present disclosure is that the aqueous fibre-containing suspension such as a pulp containing suspension is applied onto the polymer web in at least two separate steps at the same side of the polymer web, using two head boxes. In particular embodiments, the two (or more) steps are only separated by a suction step c). This results in part of the solids of the suspension entering on and in the polymer web as a result of the deposition and subsequent (or virtually simultaneous) removal of surplus water and air, and consequently the remaining part(s) of the suspended solids to be even more evenly spread over the width of the web. The water content of the combined web before the second pulp application step can be not more than 85 wt. %, not more than 80 wt. %, in particular between 60 and 75 wt. %. Thus, the dry solids content of the fibrous web after the first application step can be at least 15 wt. %, between 20 and 40 wt. %, between 25 and 40 wt. % or between 25 and 30 wt. %. The second (and optional further) steps are also followed (or effectively accompanied) by a suction step c).

The relative amounts of suspension (or of solids) applied in the first and second (and possibly third and further) steps can be equal. However, in particular embodiments, the suspension is applied at slightly decreasing levels. Thus, between 25 and 75 wt. % of the aqueous suspension (on dry solids basis) can be applied in a first step, between 15 and 60 wt. % of the aqueous suspension can be applied in a second step, and between 0 and 40 wt. % of the aqueous suspension can be applied in an optional third or further step. In an example, between 50 and 70 wt. of the suspension is applied in the first step and between 30 and 50 wt. % is applied in the second step. In another example, between 40 and 60 wt. % is applied in the first step, between 20 and 40 wt. % is applied in the second step and between 15 and 35 wt. % is applied in a third step. As an example, in terms of volume of suspension, an amount of 40-100 l/sec can be applied in the first step and 15-60 l/sec can be applied in a second step (on water basis).

The composition of the fibre-containing suspensions in the first head box (first application) and second head box—and optional further head boxes—is, in particular embodiments, the same. However, if desired, the composition may also be different. For example, the ratio of pulp to staple fibres may be different, or the staple fibres may be absent in one of the deposition steps, for example the second deposition step b'), or the staple fibres may be different in length or in other properties such as colour. Alternatively, the level of air—and hence of surfactant—may be different, e.g. lower in the second or further application.

d. Hydroentangling

Subsequently to the wet-laying foam-laying steps b/c), b'/c') and optionally b"/c"), the combined web is subjected to hydro-entanglement, i.e. to needle-like water jets covering the width of the running web. In particular embodiments, the hydroentangling step (or steps) is performed on a different carrier (running wire), which is more dense (smaller sieve openings) than the carrier on which the fibre-containing suspensions (and optionally first the polymer web) are deposited. In certain embodiments, the multiple hydroentanglement jets shortly sequence each other. The pressure applied may be in the order of 20-200 bar. The total energy supply in the hydroentangling may step be in the order of 100-400 kWh per ton of the treated material, measured and calculated as described in CA 841938, pages 11-12. The skilled person is aware of further technical details of hydroentanglement, as described e.g. in CA 841938 and WO 96/02701.

e. Drying

The combined, hydroentangled web can be dried, e.g. using further suction and/or oven drying at temperatures above 100° C., such as between 110 and 150° C.

f. Further Processing

The dried nonwoven can be further treated by adding additives, e.g. for enhanced strength, scent, printing, colouring, patterning, impregnating, wetting, cutting, folding, rolling, etc. as determined by the final use of the sheet material, such as in industry, medical care, household applications.

End Product

The nonwoven sheet material as produced can have any shape, but frequently it will have the form of rectangular sheets of between less than 0.5 m up to several meters. Suitable examples include wipes of 40 cm×40 cm. Depending on the intended use, it may have various thicknesses of e.g. between 100 and 2000 μm, in particular from 250 to 1000 μm. The sheet material has improved surface evenness, in particular reduced variations in thickness or basis weight per surface area unit, as compared to a similar material formed by a process known in the art, e.g. a similar process using only one head box for applying a pulp-containing material on a polymer. In particular embodiments, the difference in basis weight (in g/$m^2$) between any two spots of a defined surface area (see the Test Method in the Examples below) is less than 15%, or less than 10%. Along its cross-section, the sheet material may be essentially homogenous, or it may gradually change from relatively pulp-rich at one surface to relatively pulp-depleted at the opposite surface (as a result of e.g. wet-laying or foam-laying pulp at one side of the polymer web only), or, alternatively, from relatively pulp-rich at both surfaces to relatively pulp-depleted in the centre (as a result of e.g. wet-laying or foam-laying pulp at both sides of the polymer web—either or both in multiple steps at the same side). In a particular embodiment, the nonwoven material as produced has front and back surfaces of different composition, in that the pulp-containing suspension is applied at the same side in each separate step, and/or hydroentanglement is performed only at one side. Other structures are equally feasible, including structures not containing filaments.

The composition can also vary within rather broad ranges. As an advantageous example, the sheet material may contain between 25 and 85 wt. % of (cellulosic) pulp, and between 15 and 75 wt. % of man-made (non-cellulosic) polymer material, whether as (semi)continuous filaments or as relatively short (staple) fibres, or both. In a more detailed example, the sheet material may contain between 40 and 80 wt. % of pulp, between 10 and 60 wt. % of filaments and between 0 and 50 wt. % of staple fibres, or, for example between 50 and 75 wt. % of pulp, between 15 and 45 wt. % of filaments and between 3 and 15 wt. % of staple fibres. As a result of the present process, the nonwoven sheet material has few if any deficiencies combined with low residual levels of surfactant. In particular embodiments, the end product contains less than 75 ppm of the surfactant, less than 50 ppm, or less than 25 ppm of (water-soluble) surfactant.

The accompanying FIGURE shows an equipment for carrying out the process described herein. If used, thermoplastic polymer is fed into a heated drawing device 1 to produce filaments 2, which are deposited on a first running wire 3 to form a polymer layer. A mixing tank 4 has inlets for pulp 5, staple fibre 6, water 7 and/or 18, air 8, and surfactant (not shown). The resulting pulp-containing suspension (foam) 9 is divided into flows 14 and 15, through controllable valve 13, which flows are fed to the first head box 10 and second head box 16, respectively, which deposit the fibre mass 11 and 17, respectively, on one side of the polymer layer. Suction boxes 12 below the moving wire remove most of the liquid (and gaseous) residue of the spent pulp-containing suspension, and the resulting aqueous liquid is returned to the mixing tank through line 18. The combined pulp-polymer web 19 is transferred to a second running wire 20 and subjected to multiple hydro-entanglement steps through devices 21 producing water jets 22, with water suction boxes 23, the water being discharged and further recycled (not shown). The hydroentangled web 24 is then dried in drier 25 and the dried web 26 is further processed (not shown).

The FIGURE only serves to illustrate an embodiment and does not limit the claimed invention in any way. The same applies to the Examples below.

EXAMPLES AND TEST METHODS

Test methods used for determining properties and parameters of the nonwoven material as described herein will now be explained in more detail. Furthermore, some examples illustrate advantages of using the method within the scope of the appended claims and the product provided by such method are presented below.

Test Methods

Test Method—Formation

The even formation of the sheet was assessed by scanning A4-sized nonwoven specimens (290×200 mm), one layer at a time with black backgrounds (consisting of 3 thick black A4 sheets), in a flatbed scanner (Epson Perfection V750 PRO). The images were then converted to grey scale pictures (Grey scale 8 with 8 bit) having 1496×2204 pixels resolution using Image Pro 6.2 software (Media Cybernetics, Bethesda, Md., USA). Good formation is defined as having nonwoven fibres equally distributed in the sheet with as few thin and open areas present as possible. Pixel clusters being equal to or larger than 15 pixels and having a grey scale value below 160 are considered as formation defects in this method and are seen in the sheet either as thin areas, that can be visually seen through, or as holes. A formation value is calculated by adding the pixel count (number of individual pixels) of continuous pixel clusters being larger than 15 pixels and having grey scale values below 160 and dividing by the total number of available pixels. The formation number is essentially the relative amount of thin areas and holes to thicker areas with good formation expressed in percentages. Materials with low formation numbers have better formation and thus better fibre distribution than materials with higher numbers.

Test Method—Basis Weight

The basis weight (grammage) can be deter lined by a test method following the principles as set forth in the following standard for determining the basis weight: WSP 130.1.R4 (12) (Standard Test Method for Mass per Unit Area). In the Standard Method, test pieces of 100×100 mm are punched from the sample sheet. Test pieces are chosen randomly from the entire sample and should be free of folds, wrinkles and any other deviating distortions. The pieces are conditioned at 23° C., 50% RH (Relative Humidity) for at least 4 hours. A pile of ten pieces is weighed on a calibrated balance. The basis weight (grammage) is the weighed mass divided by the total area (0.1 $m^2$), and recorded as mean value with standard deviations.

In the present Examples, best and worst quality samples are selected from a sample sheet of 2×1.5 m area. The sheet is placed on a dark surface and the five best and five worst areas are marked based on visual inspection, the least transparent (closest to the original colour) and least irregular ones being qualified as "best" and the most transparent (dark) or irregular ones as "worst". All marked areas are punched out as circles of 140 mm diameter of each of the five best and five worst spots. The samples are conditioned and then weighed as described above. The basis weight (in $g/m^2$) is recorded. This method of selecting, conditioning and weighing circular test samples of 140 mm diameter represents the test method for determining the difference in basis weight for different spots of the finished sheet materials of the present disclosure.

Test Method—Thickness

The thickness of a sheet material as described herein can be determined by a test method following the principles of the Standard Test Method for Nonwoven Thickness according to EDANA, WSP 120.6.R4 (12). An apparatus in accordance with the standard is available from IM TEKNIK AB, Sweden, the apparatus having a Micrometer available from Mitutoyo Corp, Japan (model ID U-1025). The sheet of material to be measured is cut into a piece of 200×200 mm and conditioned (23° C., 50% RH, ≥4 hours). The measurement should be performed at the same conditions. During measurement the sheet is placed beneath the pressure foot which is then lowered. The thickness value for the sheet is then read after the pressure value is stabilised. The measurement is made by a precision Micrometer, wherein a distance created by a sample between a fixed reference plate and a parallel pressure foot is measured. The measuring area of the pressure foot is 5×5 cm. The pressure applied is 0.5 kPa during the measurement. Five measurements could be performed on different areas of the cut piece to determine the thickness as an average of the five measurements.

Example 1 (Comparative Embodiment)

An absorbent sheet material of nonwoven that may be used as a wipe such as an industrial cleaning cloth was produced by laying a web of polypropylene filaments on a running conveyor fabric and then applying on the polymer web a pulp dispersion containing a 88:12 weight ratio of wood pulp and polyester staple fibres, and 0.01-0.1 wt. % of a non-ionic surfactant (ethoxylated fatty alcohol) by foam forming in a head box, introducing a total of about 30 vol. % of air (on total foam volume). The weight proportion of the polypropylene filaments was 25 wt. % on dry weight basis of the end product. The amounts were chosen so as to arrive at a basis weight of the end product of 55 g/m$^2$. The combined fibre web was then subjected to hydroentanglement using multiple water jets at increasing pressures of 40-100 bar providing a total energy supply at the hydroentangling step of about 180 kWh/ton as measured and calculated as described in CA 841938, pp. 11-12 and subsequently dried.

The even formation and the basis weight of the sheet were assessed as described above. The formation data for five different samples of the nonwoven at the best and worst sites are presented in Table 1 below, under the headings "Single Head Box", with averages and standard deviations. The basis weight data (in g/cm$^2$) for the same samples are presented in Table 2 below, under the headings "Single Head Box", with averages and standard deviations.

Example 2 (Inventive Embodiment)

Example 1 was repeated with the only difference that the pulp dispersion was applied in two stages, using two head boxes placed at a distance of about 2 m from each other along the production line. The formation data and basis weight data for five samples at the best and worst sites are presented in Table 1 and Table 2, respectively, under the headings "Double Head Box".

TABLE 1

Formation results (in %)

| | Example 1 | | Example 2 | |
|---|---|---|---|---|
| | Single Head Box - worst | Single Head Box - best | Double Head Box - worst | Double Head Box - best |
| 1 | 1.84 | 0.22 | 1.77 | 0.38 |
| 2 | 0.56 | 0.12 | 1.44 | 0.55 |
| 3 | 4.74 | 0.25 | 1.00 | 0.41 |
| 4 | 5.08 | 0.10 | 1.00 | 0.37 |
| 5 | 4.21 | 0.18 | 1.81 | 0.26 |
| Average | 3.29 | 0.17 | 1.41 | 0.40 |
| Std. dev. | 1.77 | 0.06 | 0.35 | 0.10 |

Table 1 shows that the formation values of the worst spots decrease significantly when using two head boxes versus using a single one (average from 3.29 to 1.41%) and that the standard deviation decreases significantly (for the worst spots). Also, the difference between worst and best strongly decreases, when using two head boxes as compared to one.

TABLE 2

Basis weight results (in g/m$^2$)

| | Example 1 | | Example 2 | |
|---|---|---|---|---|
| | Single Head Box - worst | Single Head Box - best | Double Head Box - worst | Double Head Box - best |
| 1 | 51.5 | 62.1 | 55.6 | 58.6 |
| 2 | 57.9 | 61.9 | 53.3 | 59.4 |
| 3 | 47.8 | 61.9 | 54.1 | 58.0 |
| 4 | 46.0 | 63.0 | 54.7 | 61.5 |
| 5 | 49.1 | 62.8 | 53.7 | 59.9 |
| Average | 50.5 | 62.3 | 54.3 | 59.5 |
| Std. dev. | 4.1 | 0.5 | 0.8 | 1.2 |

Table 2 shows that the basis weight improves significantly for the worst spots and that the difference between worst and best decreases significantly.

Example 3 (Comparative Embodiment)

Example 1 was repeated with the only difference that the amounts were chosen so as to arrive at a basis weight of the end product of 80 g/cm$^2$. The formation data for 5 different samples of the nonwoven at the best and worst sites are presented in Table 3 below, under the headings "Single Head Box", with averages and standard deviations. The basis weight data for the same samples are presented in Table 4 below, under the headings "Single Head Box", with averages and standard deviations.

Example 4 (Inventive Embodiment)

Example 3 was repeated with the only difference that the pulp dispersion was applied in two stages, using two head boxes placed at a distance of about 2 m from each other along the production line. The formation data and basis weight data for five samples at the best and worst sites are presented in Table 3 and Table 4, respectively, under the headings "Double Head Box".

TABLE 3

Formation results (in %)

| | Example 3 | | Example 4 | |
|---|---|---|---|---|
| | Single Head Box - worst | Single Head Box - best | Double Head Box - worst | Double Head Box - best |
| 1 | 0.28 | 0.16 | 0.01 | 0.00 |
| 2 | 0.39 | 0.04 | 0.05 | 0.06 |
| 3 | 0.44 | 0.06 | 0.04 | 0.01 |
| 4 | 0.12 | 0.03 | 0.02 | 0.10 |
| 5 | 0.25 | 0.13 | 0.02 | 0.02 |
| Average | 0.30 | 0.08 | 0.03 | 0.04 |
| Std. dev. | 0.11 | 0.05 | 0.01 | 0.04 |

Table 3 shows that the formation values for the worst spots decrease significantly when using two head boxes versus using a single one (average from 0.30 to 0.03) and that the standard deviation decreases significantly (for the worst spots). Also the difference between worst and best spots almost disappears.

TABLE 4

| Basis weight results (in g/m$^2$) | | | | |
|---|---|---|---|---|
| | Example 3 | | Example 4 | |
| | Single Head Box - worst | Single Head Box - best | Double Head Box - worst | Double Head Box - best |
| 1 | 68.5 | 85.8 | 70.9 | 82.4 |
| 2 | 66.5 | 80.2 | 73.6 | 75.7 |
| 3 | 66.4 | 80.8 | 71.8 | 82.2 |
| 4 | 74.3 | 85.0 | 75.3 | 79.9 |
| 5 | 74.8 | 86.3 | 74.1 | 80.5 |
| Average | 70.1 | 83.6 | 73.1 | 80.1 |
| Std. dev. | 3.7 | 2.6 | 1.6 | 2.4 |

Table 4 indicates that the basis weight improves significantly for the worst spots and that the difference between worst and best decreases significantly.

As a result of the improved formation and basis weight a material produced using two head boxes has better fibre distribution than the material formed using one head box. Thus, the material formed using two head boxes is more even than the one formed using one head box. The formation number is essentially the relative amount of thin areas and holes to thicker areas with good formation expressed in percentages. Materials with low formation numbers have better formation and thus better fibre distribution than materials with higher numbers.

The invention claimed is:

1. A process of producing a hydroentangled nonwoven sheet material of at least one of natural or manmade fibres, comprising:

a) providing an aqueous suspension containing short fibres having lengths from 1 to 25 mm and a surfactant;

b) depositing the aqueous suspension on a carrier;

c) removing aqueous residue of the aqueous suspension deposited in step b) to form a fibrous web;

b') depositing another aqueous suspension containing short fibres and surfactant on the surface of the fibrous web formed in step c) and at the side not facing the carrier, wherein the aqueous suspension and the another aqueous suspension include the same composition;

c') removing aqueous residue of the aqueous suspension deposited in step b') to form a combined fibrous web; and subsequently d) hydroentangling the combined fibrous web.

2. The process according to claim 1, wherein the short fibres comprise at least one of at least 25 wt. % of cellulosic pulp having fibre lengths of between 1 and 5 mm, or at least 3 wt. % of staple fibres having fibre lengths of between 5 and 25 mm.

3. The process according to claim 1, wherein the another aqueous suspension is a portion of the aqueous suspension in step b).

4. The process according to claim 3, wherein between 25 and 75 wt. % of the aqueous suspension, on dry solids basis, is applied in step b), between 15 and 60 wt. % of the aqueous suspension is applied in step b'), and between 0 and 40 wt. % of the aqueous suspension is applied in one or more optional further steps b") following step c').

5. The process according to claim 1, wherein the dry solids content of the fibrous web after step c) and before step b') is at least 15 wt. %.

6. The process according to claim 1, wherein the aqueous suspension and the another aqueous suspension are each applied as a foam containing between 10 and 90 vol. % of air.

7. The process according to claim 1, wherein the aqueous suspension contains between 0.01 and 0.1 wt. % of a non-ionic surfactant, and wherein the nonwoven sheet material contains less than 75 ppm of the surfactant.

8. The process according to claim 1, wherein a polymer web is deposited prior to step b), after step c'), or a polymer web is deposited prior to step b) and after step c').

9. The process according to claim 8, wherein the polymer web contains at least 50 wt. % of synthetic filaments, and the combined web contains between 15 and 45 wt. % of the synthetic filaments on dry solids basis of the combined web.

10. The process according to claim 1, wherein the nonwoven material as produced has front and back surfaces of different composition, in that hydroentanglement of step d) is performed only at one side.

* * * * *